US010620575B2

(12) United States Patent
Castells De Monet et al.

(10) Patent No.: US 10,620,575 B2
(45) Date of Patent: Apr. 14, 2020

(54) LIGHT PROJECTION FOR A PRINT SUBSTRATE

(71) Applicant: Hewlett-Packard Development Company, L.P., Houston, TX (US)

(72) Inventors: Raimon Castells De Monet, Barcelona (ES); David Toussaint, Barcelona (ES); Jose Miguel Ibanez Borau, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 78 days.

(21) Appl. No.: 15/570,242

(22) PCT Filed: May 8, 2015

(86) PCT No.: PCT/US2015/029850
§ 371 (c)(1),
(2) Date: Oct. 27, 2017

(87) PCT Pub. No.: WO2016/182539
PCT Pub. Date: Nov. 17, 2016

(65) Prior Publication Data
US 2019/0129340 A1 May 2, 2019

(51) Int. Cl.
*G03G 15/00* (2006.01)
*G03G 15/043* (2006.01)

(52) U.S. Cl.
CPC ..... *G03G 15/5029* (2013.01); *G03G 15/043* (2013.01)

(58) Field of Classification Search
CPC ..... G03G 15/5029; B41J 2/125; B41J 11/009; B41J 11/20; B41J 25/308; G01B 11/028; H04N 1/00058; H04N 1/4015
USPC ..... 356/445, 614–624, 630
See application file for complete search history.

(56) References Cited

U.S. PATENT DOCUMENTS

| | | | | |
|---|---|---|---|---|
| 4,737,645 | A | 4/1988 | Lahr | |
| 6,140,662 | A | 10/2000 | Lim et al. | |
| 6,940,664 | B1 | 9/2005 | Pilu | |
| 7,649,545 | B2 | 1/2010 | Antonis | |
| 7,663,769 | B2 | 2/2010 | Hayashihara et al. | |
| 7,893,416 | B2 | 2/2011 | Dror | |
| 2009/0086217 | A1* | 4/2009 | Hayashihara | G03G 15/5029 356/630 |
| 2011/0199412 | A1 | 8/2011 | Nakayama | |
| 2011/0279507 | A1 | 11/2011 | Castillo et al. | |
| 2013/0251383 | A1 | 9/2013 | Imazeki et al. | |
| 2014/0265105 | A1* | 9/2014 | Shimoyama | B65H 7/14 271/12 |

(Continued)

OTHER PUBLICATIONS

Unknown, "Shadowmaster Direct Thickness Gauge", Thermo Scientific, Retrieved form Internet, Feb. 27, 2015, 2 pages.

*Primary Examiner* — Isiaka O Akanbi
(74) *Attorney, Agent, or Firm* — HP Inc. Patent Department

(57) ABSTRACT

In some examples, a method includes capturing an image of a light projection across a print substrate and a background surface beside the background surface. The method may also include identifying a break point in the image where a gap in the light projection occurs and determining a thickness of the print substrate, an edge location of the print substrate, or both, using the break point in the image.

16 Claims, 8 Drawing Sheets

(56) References Cited

U.S. PATENT DOCUMENTS

| | | | | |
|---|---|---|---|---|
| 2015/0029257 | A1 | 1/2015 | Isoda | |
| 2015/0029525 | A1 * | 1/2015 | Shimoyama ..... | B65H 3/128<br>358/1.12 |

* cited by examiner

LIGHT PROJECTION FOR A PRINT SUBSTRATE

BACKGROUND

A printer may be used to print in any number of environments, including a high-productivity environment where it is desirable to avoid halting print production. Errors in a printing process may cause product delays, repeated print jobs, profit losses, or other consequences. Increasing the reliability and accuracy of a printing process may improve printer performance.

BRIEF DESCRIPTION OF THE DRAWINGS

Certain examples are described in the following detailed description and in reference to the drawings.

DETAILED DESCRIPTION

The discussion below refers to a print substrate. A print substrate may be any medium on which a printing process takes place. A print substrate may thus be a base material on which an image is printed or on which a deposition of consumable fluids or powder-based build material is applied. Examples of a print substrate may thus include paper, plastic films or foils, textiles, fabrics, parchment, foamboards, methacrylate, metal sheets, and countless other mediums.

The discussion below may provide devices, systems, logic, circuitry, and methods for determining print substrate characteristics through light projection and subsequent image analysis. Through such print substrate characteristic determinations, a printing device may adapt a printing process to account for a particular substrate thickness or edge location, which may ensure the print substrate is properly aligned and the printing process accounts for the substrate height when printing. Thus, the features disclosed herein may result in increased reliability, accuracy, and efficiency in the print process as well as increased image quality. Moreover, through use of light projection and image analysis, the substrate characteristic determination features discussed below may allow the printing device to make printer setting adjustments with reduced performance impact and automatically, without user intervention.

Figure 1:
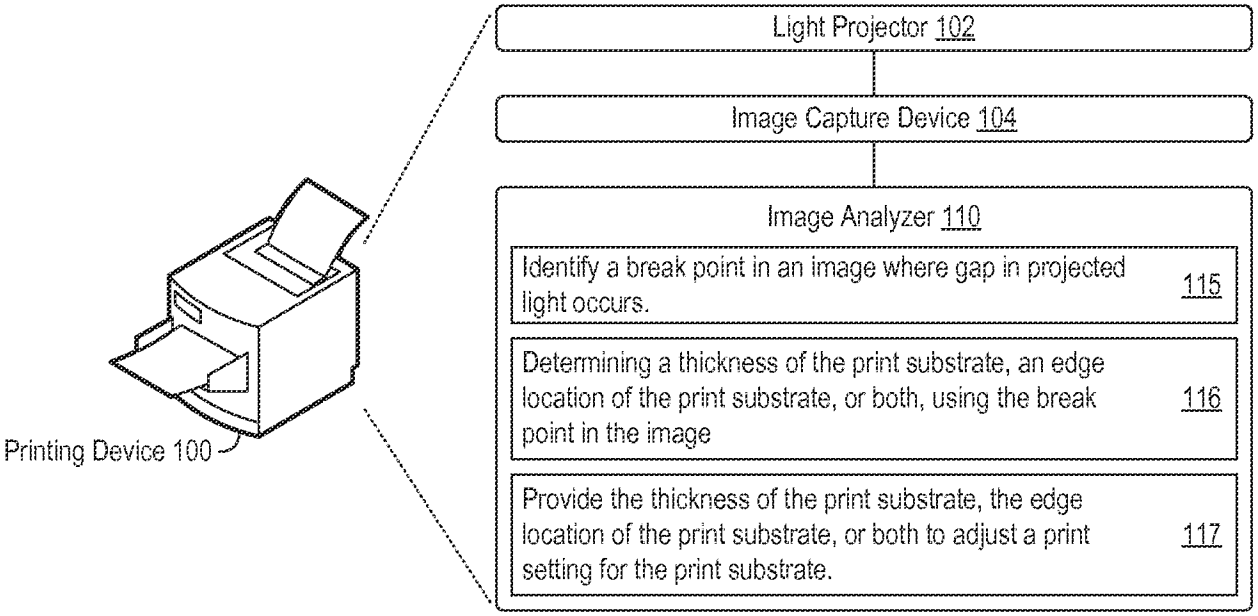
FIG. 1 shows an example of a printing device that supports a characteristic determination of a print substrate through light projection.

FIG. 1 shows an example of a printing device 100 that supports a characteristic determination of a print substrate through light projection. The printing device 100 may support any number of printing techniques, such as inkjet printing, three-dimensional printing (e.g., deposition of consumable fluids in a layer-wise additive manufacturing process), liquid electro-photographic printing (including single-shot and multi-shot), xerography, and more. Likewise, the printing device 100 may support printing on any number or types of print substrates, including printing of multiple substrates in parallel.

The printing device 100 may determine various characteristics of a print substrate through light projection. To do so, the printing device 100 may include a light projector 102. The light projector 102 may be any device or circuitry that emits a light, such as a laser or light emitting diode (LED). In operation, the light projector 102 may cause a light projection across a print substrate and a background surface beside the print substrate. The printing device 100 may also include an image capture device 104. The image capture device 104 may support capture of digital images or videos, and may take the form of any type of digital camera. In operation, the image capture device 104 may capture an image of the light projection across the print substrate and the background surface.

From the captured image, the printing device 100 may perform various image analyses to identify characteristics of the print substrate. In that regard, the printing device 100 may include an image analyzer 110. The image analyzer 110 may be implemented as logic, a module, a subsystem, or circuitry of the printing device 100, for example as executable instructions stored on a machine-readable medium of the printing device 100. In some examples, the image analyzer 110 is implemented as part of a printer controller for the printing device 100.

The image analyzer 110 may analyze an image of a light projection across a print substrate and background surface to identify characteristics of the print substrate, such as a thickness of the print substrate, an edge location of the print substrate, or both. In the particular example shown in FIG. 1, the image analyzer 110 includes the components labeled as 115, 116, and 117, which may be logic, sub-modules, circuitry, or executable instructions implemented as part of the image analyzer 110. Through the components 115, 116, and 117, the image analyzer 110 may identify a break point in an image where a gap in the light projection occurs; determine a thickness of the print substrate, an edge location of the print substrate, or both, using the break point in the image; and provide the thickness of the print substrate, the edge location of the print substrate, or both to adjust a print setting for the printing device 100.

Figure 2:
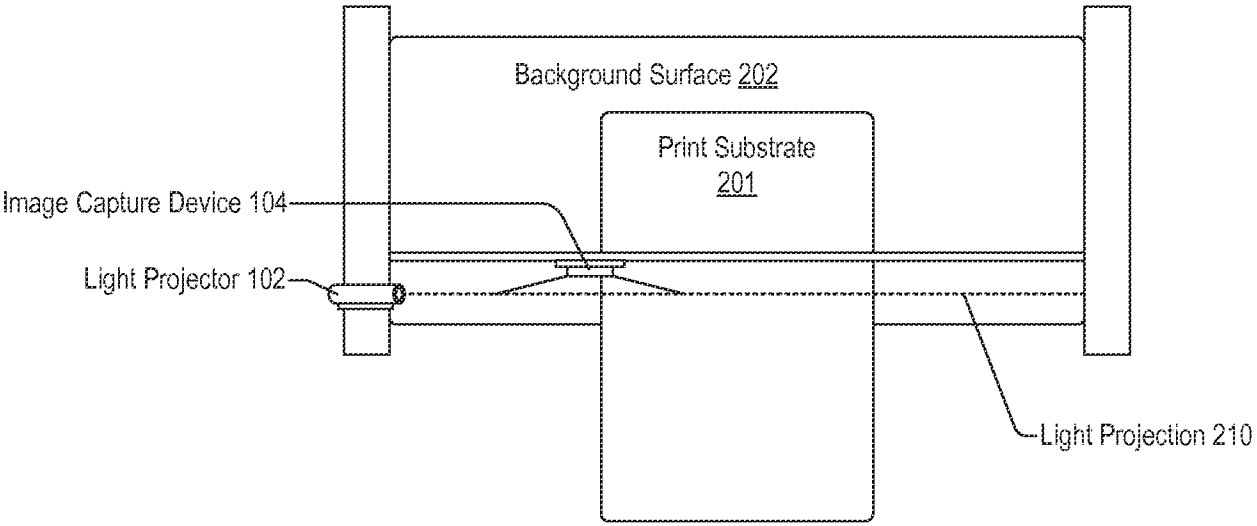
FIG. 2 shows an example of an image capture that supports a characteristic determination of a print substrate through light projection.

FIG. 2 shows an example of an image capture that supports a characteristic determination of a print substrate through light projection. The example image capture shown in FIG. 2 may be performed by the printing device 100, for example. In FIG. 2, a print substrate 201 is positioned on top of a background surface 202. The background surface 202 may extend beyond an edge of the print substrate 201 as well, and thus the background surface 202 may surround the print substrate 201 along different edges of the print substrate 201.

A light projector 102 may project a light projection 210 across the print substrate 201 and the background surface 202, allowing an image capture device 104 to capture an image of the light projection 210 across the print substrate 201 and the background surface 202 beside the print substrate 201. In FIG. 2, a light projection 210 is shown as the dotted line emitted by the light projector 102 and traversing across the background surface 202 and the print substrate 201. The light projection 210 may take the form of a beam of light. In some examples, the light projector 102 causes the light projection 210 by projecting a collimated light across the print substrate 201 and the background surface 202. The light projector 102 may control various aspects of the light projection 210, such as a light color (e.g., as specified through wavelength), size, strength (e.g., power), or any other characteristic of the light projection 210. These light characteristics may be configurable by the image analyzer 110 or a print controller to support subsequent image analysis. For instance, the image analyzer 110 may instruct the light projector 102 to project the light projection 210 as a red light beam at a power of 0.1 milliWatt (mW) allowing the image analyzer 110 to identify the light projection 210 from a captured image through the configured light characteristics.

The image capture device 104 may be positioned to capture image elements later used to determine substrate characteristics of the print substrate 201. In particular, an image capture device 104 may be positioned such that the light projection 210, an edge of the print substrate 201, and a portion of the background surface 202 beside the print substrate 201 are within a field of view of the image capture device 104. In some examples, the image capture device 104 is positioned above the print substrate 201 and background surface 202, such that a lens of the image capture device 104 points downward towards the light projection 210, the print substrate 201 and the background surface 202. In some examples, a field of view of the image capture device 104 is in plane perpendicular to a surface plane of the print substrate 201 and the background surface 202 that the light projection 210 traverses across.

The light projector 102 and the image capture device 104 may be implemented at a particular portion of a printing device. In some implementations, the image capture device 104 is positioned to capture an image of the light projection 210 at a substrate input area of a printing device. In these implementations, the light projector 102 and the image capture device 104 may be positioned proximate to or as part of the substrate input area, such as input platform or input tray of the printing device. The background surface 202 may thus be an input feeding tray or platform through which the print substrate 201 is loaded into the printing device, and the image capture device 104 may capture images of the light projection 210 as the print substrate 201 enters or moves across the field of view of the image capture device 104.

The image capture device 104 may capture an image of the light projection 210 across the print substrate 201 and background surface 202 according to any number of capture parameters. The capture parameters may specify an image capture rate, periodicity, resolution, capture triggers, or any other parameters by which the image capture device 104 captures images. In some examples, the capture parameters may direct the image capture device 104 to capture one image per print substrate loaded through a substrate input area. In other examples, the image capture device 104 may capture multiple images per print substrate. As yet another example, the capture parameters may direct the image capture device 104 to capture video data for print substrates, and the image analyzer 110 may analyze any of captured video frames to support substrate thickness or edge location determinations for print substrates. The capture parameters may be configurable, for example through a user interface, by the image analyzer 110, or in response to a system administrator instruction.

Figure 3:
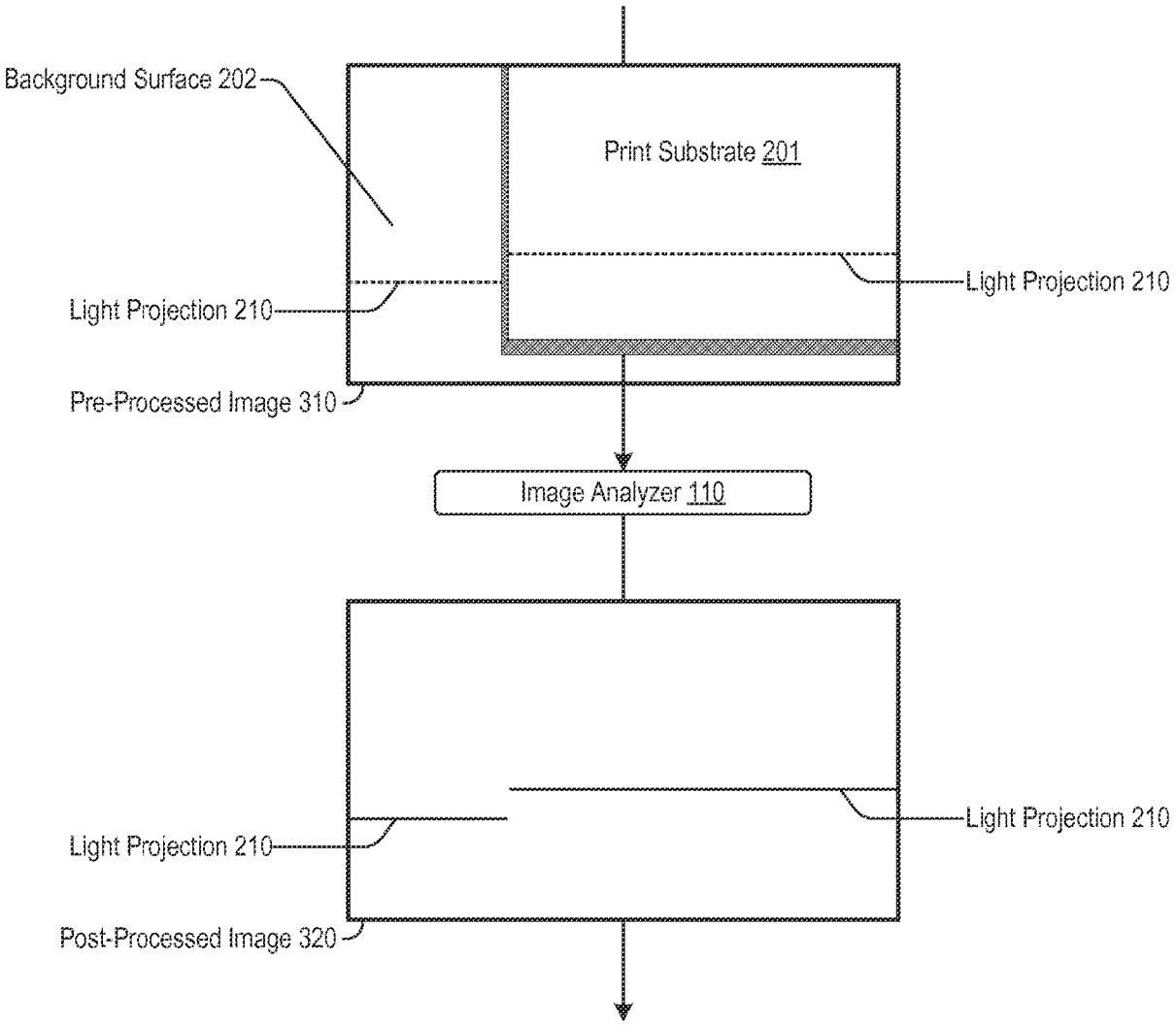
FIG. 3 shows an example of image processing that an image analyzer may perform to support a characteristic determination of a print substrate.

After capture of an image of the light projection 210 across the print substrate 201 and the background surface 202, the image analyzer 110 may process the image to determine various print substrate characteristics, such as substrate thickness and edge location. Some image processing and image analysis examples are presented next in FIGS. 3, 4, and 5. Referring to FIG. 3, FIG. 3 shows an example of image processing that the image analyzer 110 may perform to support a characteristic determination of a print substrate.

The image analyzer 110 may process an image that includes the light projection across the print substrate and background surface to support subsequent determination of a print substrate characteristics through the image. The processing performed by the image analyzer 110 may include optical adjustments, corrections, or filtering to support subsequent image analyses. In FIG. 3, the image analyzer 110 receives a pre-processed image 310. As a continuing illustration, the image processed by the image analyzer 110 may be a raw image captured by the image capture device 104 in FIG. 2, and may thus depict the light projection 210 across the print substrate 201 and background surface 202 beside the print substrate 201. The image analyzer 110 may process the pre-processed image 310 to obtain the post-processed image 320, and in a way to identify or emphasize the light projection 210.

As one example form of image processing, the image analyzer 110 may increase an image contrast between the light projection and other elements of the image, such as the print substrate and background surface. In that regard, the image analyzer 110 may specifically identify the light projection 210 from the pre-processed image 310, such as through a particular color (e.g., red), image pattern, or other attribute of the light projection 210 in the pre-processed image 310. In operation, the image analyzer 110 may filter other elements of the pre-processed image 310 that are not the color of the light projection 210, thus specifically identifying the light projection 210 from the pre-processed image 310. Processing of the pre-processed image 310 may include color adjustments as well, such as setting the light projection 210 to a first particular color and other non-light projection elements to second particular color that contrasts the first particular color. In the example shown in FIG. 3, the image analyzer 110 obtains the post-processed image 320 showing the light projection 210 in black, but not showing other elements of the pre-processed image 310 (or, coloring the non-light projection elements as white).

As another example of image processing, the image analyzer 110 may correct an optical aberration from the pre-processed image 310. In some examples, the image analyzer 110 processes an image to reduce optical skew. The optical skew may result from an image capture angle between an image capture device and a print substrate, which may result in a distortion of the light projection across the print substrate and background surface. Such distortions may include a distorted image angle, pattern, light projection trajectory, or other inaccuracy in the pre-processed image 310 with regards to the light projection 210. The image analyzer 110 may access image capture angle data determined through a mounting angle or position of image capture device 104, thus allowing the image analyzer 110 to determine a resulting optical skew and process the pre-processed image 310 accordingly. For example, the image capture angle data may be stored on a printing device through input from a user interface, mechanical measures, or via other mechanisms. Thus, as described above, the image analyzer 110 may process an image for subsequent image analysis by identifying or emphasizing the light projection.

Figure 4:
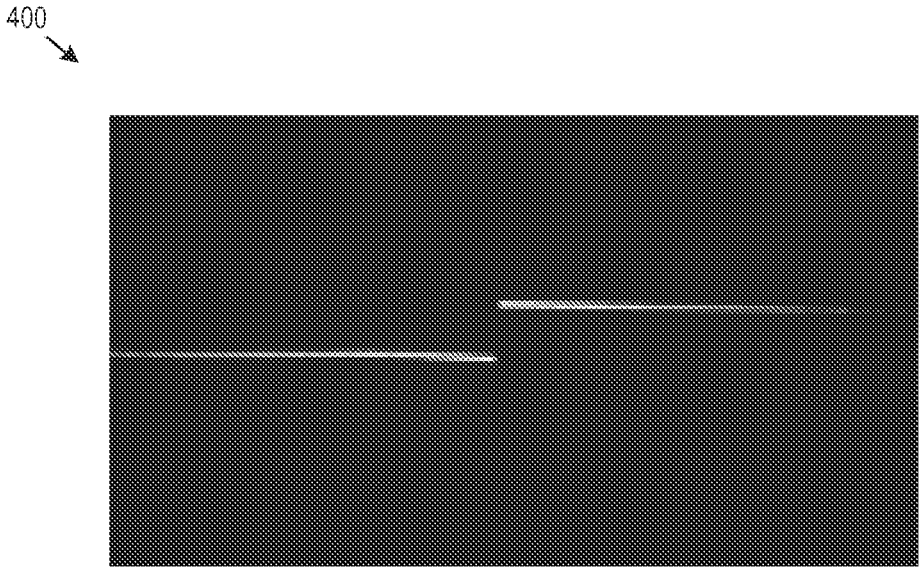
FIG. 4 shows an example of an image processed by the image analyzer.

FIG. 4 shows an example of an image 400 processed by the image analyzer 110. To generate the example image 400 shown in FIG. 4, the image analyzer 110 may process a captured image to increase a contrast between the light projection in the image and other portions of the image, such as the print substrate and background surface. As seen in FIG. 4, the image analyzer 110 may process a captured image such that the light projection is colored white, and other portions of the captured image are colored black. Thus, the image analyzer 110 may emphasize the light projection in the image 400, which may increase the accuracy or ease of subsequent analysis to determine print substrate characteristics, such as the substrate thickness and an edge location of the print substrate. The image 400 shown in FIG. 4 may be a post-processed image resulting from image processing by the image analyzer 110.

Figure 5:
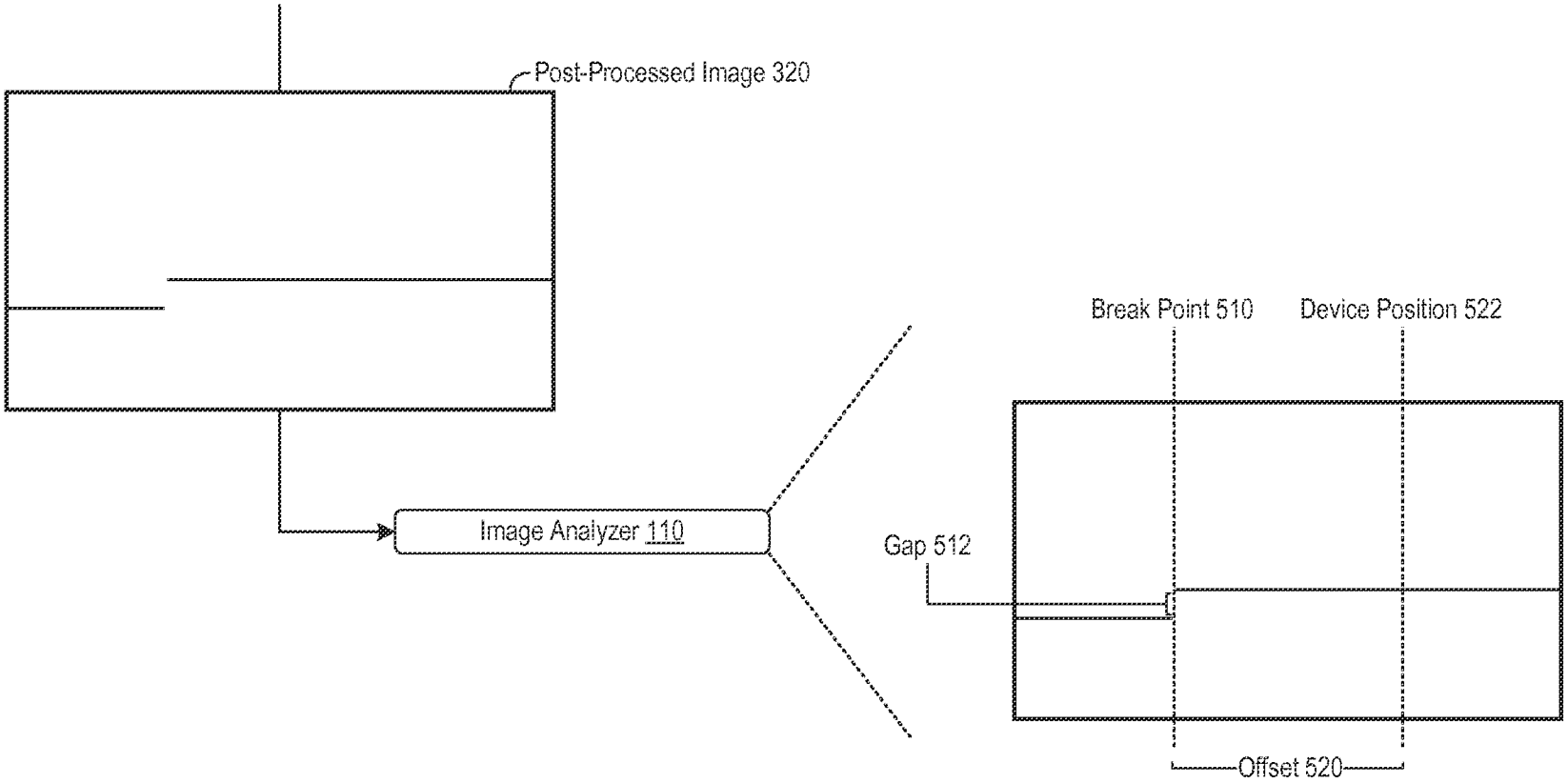
FIG. 5 shows an example of image analysis that the image analyzer may perform to determine a thickness of the print substrate, an edge location of the print substrate, or both.

FIG. 5 shows an example of image analysis that the image analyzer 110 may perform to determine a thickness of the print substrate, an edge location of the print substrate, or both. The image analyzer 110 may analyze a post-processed image showing a light projection, such as the post-processed image 320 in FIG. 3 or the image 400 in FIG. 4. For the example in FIG. 5, the image analyzer 110 analyzes a post-processed image, specifically the post-process image 320 from FIG. 3. However, the image analyzer 110 may analyze any image showing the light projection, such as the pre-processed image 310 for example.

In analyzing an image of a light projection, the image analyzer 110 may identify a break point in the image. The image analyzer 110 may identify a break point as an image location at which a gap in the light projection occurs. The gap may be a point in the light projection where the light projection is no longer continuous, which may occur due to a height difference between the print substrate and the background surface besides the print substrate. As such, the gap in the light projection may indicate a position of the print substrate relative to the background surface, e.g., a point where the background surface and the print substrate border one another. In the example shown in FIG. 5, the image analyzer 110 identifies the gap 512 in the light projection in the post-processed image 320 where the light projection is no longer continuous. The image analyzer 110 may thus identify the break point 510 in the post-processed image 320, e.g., at the horizontal position in the post-processed image 320 where the gap 512 in the light projection occurs.

Using the identified break point, the image analyzer 110 may determine a thickness of the print substrate. The image analyzer 110 may determine the thickness of the print substrate as a gap length of the gap 512 occurring at the break point 510. As the gap 512 in the light projection may result from a height difference between the print substrate relative to the background surface, the length of the gap 512 may indicate a height (e.g., thickness) of the print substrate. Thus, the image analyzer 110 may measure, from the image, the length of the gap 512 to determine the thickness of the print substrate. When the image of the light projection depicts captured elements at a one-to-one scale (e.g., as set by capture settings of an image capture device 104), the image analyzer 110 may determine the thickness of the print substrate by directly measuring the gap length. When a different scaling is used in image capture, the image analyzer 110 may adjust a measured gap length measured from the analyzed image to account for the scaling difference in the captured image. Thus, the image analyzer 110 may determine the thickness a print substrate through image analysis of an image of the light projection.

Using the identified break point, the image analyzer 110 may determine an edge location of the print substrate. As the break point 510 may indicate a point at which the background surface and print substrate border one another, the break point 510 may thus indicate where the edge of the print substrate occurs. Thus, in some examples, the image analyzer 110 identifies the edge location of the print substrate through an offset of the break point 510 from a device location of an image capture device that captures the image. The image analyzer 110 may access such device location information, which may be input or stored to indicate a particular positioning of the image capture device.

In the example shown in FIG. 5, the image analyzer 110 identifies the device position 522 and the break point 510, and thus determines the offset 520 from the device position 522. From the offset 520, the image analyzer 110 may determine the edge location, e.g., as the offset 520 itself or relative to a target position of a printing device, e.g., an input tray edge or a target edge position for printing substrates input into a printing device. These target positions may be specified relative to the device position 522 of an image capture device, and thus the image analyzer 110 may identify an alignment difference between the actual edge location of the print substrate (as determined through the image analysis) and a target edge position.

In some examples, an image captured by the image capture device 104 may depict the light projection across a background surface, but not a surface of the print substrate. Such a scenario may occur when the print substrate absorbs or reflects the light beam projected by a light projector 102. Examples of such print substrates may include black colored (or other light-absorbent) substrates, mirror substrates that reflect the light projection, and more. In these examples, the image analyzer 110 may nonetheless identify a break point in the image, e.g., at a position in the image where the light projection ends (and thus a discontinuity in the light projection occurs). The positioning of the break point in the image may indicate the edge location of the print substrate, which the image analyzer 110 may determine as described above. However, the image may not include a gap length for the light projection, as the light projection ends as opposed to resuming at a different point in the image.

To determine the thickness of a particular print substrate when the light projection does not traverse across the print substrate, the image analyzer 110 may access predetermined thickness characteristic data for the particular print substrate. The predetermined thickness characteristic data may be calculated through prior image analysis of a light projection across the particular print substrate overlaid with a covering upon which the light projection can traverse (e.g., a non-absorbent or non-reflective material). To illustrate, the image analyzer 110 may access a captured image of the light projection across the covering when overlaid across the particular print substrate. In analyzing the image, the image analyzer 110 may identify a thickness of the particular print substrate as a gap length from the captured image minus the thickness of the covering, which may be predetermined or measured. The predetermined thickness characteristic data of the particular print substrate may be stored on a storage medium accessible to the image analyzer 110, such as a memory of a printing device. Thus, the image analyzer 110 may determine the thickness of a particular print substrate even when the light projection does not traverse across the surface of the print substrate.

In some examples, the image analyzer 110 causes adjusting of a print setting for the print substrate according to the thickness of the print substrate, the edge location of the print substrate, or both. The image analyzer 110 may provide a determined substrate thickness or edge location to a print controller, allowing the print controller to adjust a print setting accordingly. Example adjustments may include modifying a print head height to a target distance from the surface of the print substrate to be printed on, adjusting a print head location to account for a print substrate whose edge is misaligned from an expected print boundary, or even ceasing a print job if the edge location of the print substrate is outside of the print boundary by a threshold distance.

The image analyzer 110 may support automatic substrate characteristic determination and print setting adjustments. For example, a printing device may support image capture of light projections across print substrates and a background surface as the print substrates prior to printing (e.g., at a substrate input area). In doing so, the image analyzer 110 may analyze the captured images to determine substrate thickness and edge locations prior to printing, allowing for real-time adjustments and corrections should a particular print substrate have an unexpected thickness of misaligned edge. By automatically measuring substrate thickness, the image analyzer 110 may also avoid user-caused errors, such as when an inaccurate print substrate thickness is specified through a user interface. Moreover, automatic print substrate characteristic determination may provide flexible adjustments without increased performance latency, as the image capture and image analysis may be performed without extra steps or latency for loading and printing upon the print substrate (e.g., as opposed to explicit mechanical substrate measurements, which may incur extra processing time to perform the physical measurements). The features discussed herein may therefore provide increased efficiency and reliability for a printing process as well as increased image quality.

The examples discussed above were provided in the context of one image capture device and corresponding image analysis. A printing device may implement multiple image capture devices, for example in-line across a substrate input area of the printing device. By doing so, the printing device may support multiple image captures to determine print substrate characteristics. As one illustration, multiple image capture devices may be positioned to capture multiple points of a particular print substrate, thus capture different points at which a light projection traverses across the particular print substrate. When different points of the print substrate have different thicknesses (e.g., a print substrate with tiles of varying height), the multiple image captures may support determination of the different thicknesses by the image analyzer 110, e.g., via multiple break points identified in images captured by the multiple image capture devices.

Figure 6:
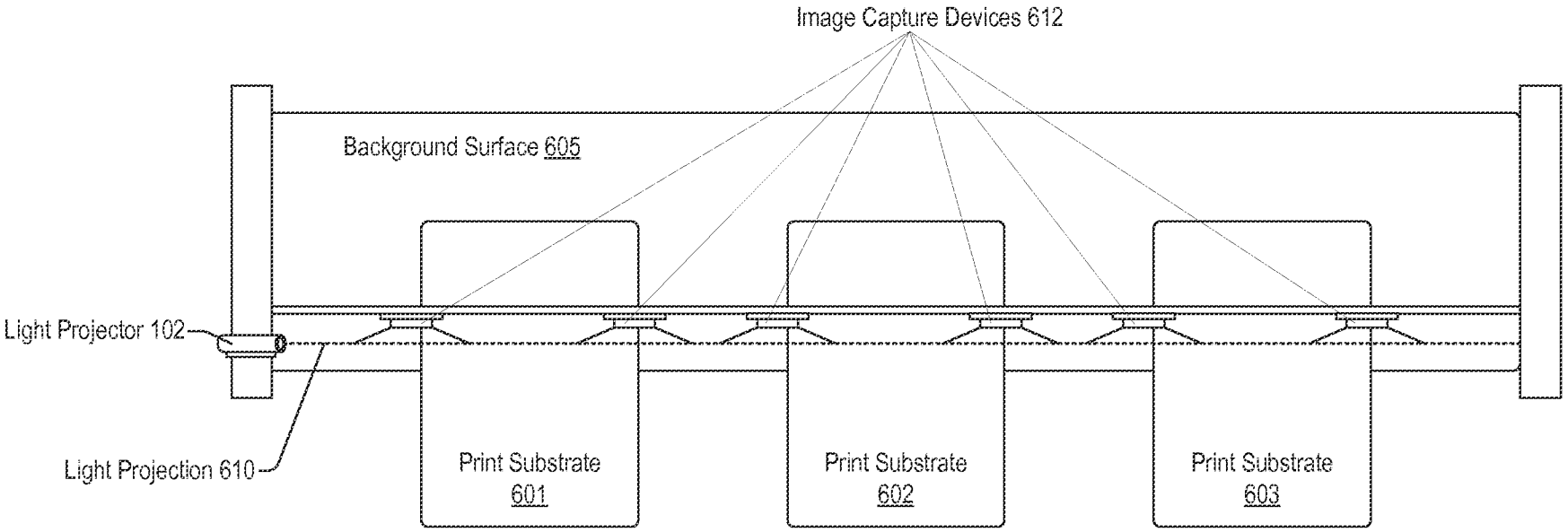
FIG. 6 shows an example of multiple image captures to support characteristic determinations of multiple print substrates.

As another example, multiple image captures may allow an image analyzer 110 to determine print substrate characteristics of multiple print substrates, such as when the multiple print substrates are input into a printing device in parallel. FIG. 6 shows an example of multiple image captures to support characteristic determinations of multiple print substrates.

In the example shown in FIG. 6, multiple print substrates labeled as 601, 602, and 603 are positioned upon a background surface 605. A light projector 102 causes a light projection 610 to traverse across the print substrates 601, 602, and 603 as well as the background surface 605 besides the print substrates 601, 602, and 603. The example shown in FIG. 6 may depict a substrate input area of a print device for example, and such a print device may support input or printing of multiple substrates in parallel. The example shown in FIG. 6 also includes multiple image capture devices positioned in-line to respectively capture images of a particular portion of the background surface 605 and print substrate. The multiple image capture devices shown in FIG. 6 are collectively labeled as the image capture devices 612.

Through the multiple image capture devices 612, a printing device may support simultaneous image capture of multiple print substrates processed in parallel by the printing device. Using the multiple images captured by the image capture devices 612, the image analyzer 110 may determine print substrate characteristics for some or all of the print substrates 601, 602, and 603, e.g., as the print substrates 601, 602, and 603 are received in parallel by a printing device. An image analyzer 110 may identify, in particular, a respective thickness and edge location(s) for the print substrates 601, 602, and 603, allowing the printing device to adapt if any of the printing substrates 601, 602, or 603 are misaligned, vary in thickness, or even missing from the input area.

Figure 7:
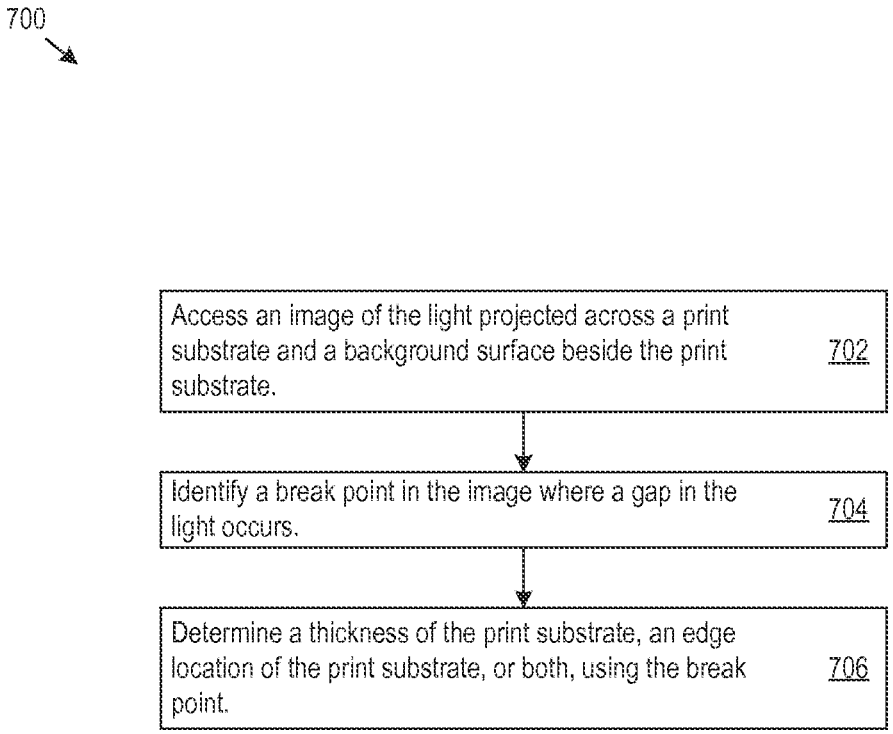
FIG. 7 shows an example of logic that supports a characteristic determination of a print substrate through light projection.

FIG. 7 shows an example of logic 700 that supports a characteristic determination of a print substrate through light projection. A printing device may implement the logic 700, for example as part of the image analyzer 110, a printer controller, or other elements of the printing device. The image analyzer 110 may perform or execute the logic 700 as a method to determine a thickness of the print substrate, an edge location of the print substrate, or both.

The image analyzer 110 may access an image of a light projection across a print substrate and a background surface beside the print substrate (702) and identify a break point in the image where a gap in the light projection occurs (704). Using the break point in the image, the image analyzer 110 may determine a thickness of the print substrate, an edge location of the print substrate, or both (706).

The image analyzer 110 may determine the thickness of the print substrate as a length of the gap at the break point in the image and determine the edge location as an offset of the break point from a device position of an image capture device used to capture the image. In some examples, different portions of the print substrate have different thicknesses. In these examples, the image analyzer 110 may identify multiple break points in the image and determine the different thicknesses of the print substrate from the multiple break points, e.g., in any of ways described above.

Figure 8:
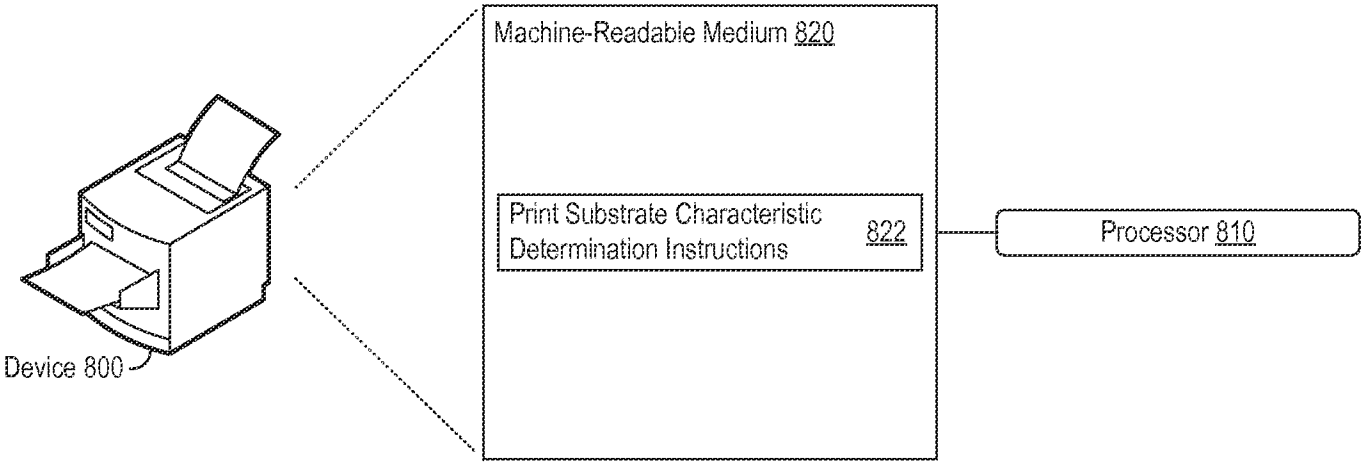
FIG. 8 shows an example of a device that supports a characteristic determination of a print substrate through light projection.

FIG. 8 shows an example of a device 800 that supports a characteristic determination of a print substrate through light projection. The device 800 may take any number of forms, such as a printing device (e.g., as shown in FIG. 8), a printer controller, any computing device, and the like. The device 800 may include a processor 810. The processor 810 may include a central processing unit (CPU), microprocessor, and/or any hardware device suitable for executing instructions stored on a machine-readable medium.

The device 800 may include a machine-readable medium 820. The machine-readable medium 820 may be any non-transitory electronic, magnetic, optical, or other physical storage device that stores executable instructions, such as the print substrate characteristic determination instructions 822 shown in FIG. 8. Thus, the machine-readable medium 820 may be, for example, Random Access Memory (RAM), an Electrically-Erasable Programmable Read-Only Memory (EEPROM), a storage drive, an optical disk, and the like.

The device 800 may execute instructions stored on the machine-readable medium 820 through the processor 810. Executing the instructions may cause the processor 810 to perform or support any combination of the features described herein, such as features with respect to the image analyzer 110 for example. To illustrate, executing the print substrate characteristic determination instructions 822 may cause the processor 810 to access an image of a print substrate on a background surface with a light projection across the print substrate and the background surface and process the image to increase a contrast between the light projection in the image and the print substrate and background surface. After processing the image, executing the print substrate characteristic determination instructions 822 may cause the processor 810 to identify a break point in the processed image where a gap in the light projection occurs and analyze the processed image to determine a thickness of the print substrate, an edge location of the print substrate, or both, according to the break point.

Regarding substrate thickness, executing the print substrate characteristic determination instructions 822 may cause the processor 810 to determine the thickness of the print substrate as a length of the gap at the break point in the image or determine. Regarding edge location, executing the print substrate characteristic determination instructions 822 may cause the processor 810 to determine the edge location as an offset of the break point from a device position of an image capture device used to capture the image. In some examples, executing the print substrate characteristic determination instructions 822 causes the processor 810 to process the image further by reducing optical skew in the image caused by an image capture angle between the print substrate and an image capture device used to capture the image.

The methods, devices, systems, and logic described above, including the image analyzer 110, may be implemented in many different ways in many different combinations of hardware, executable instructions stored on a machine-readable medium, or both. For example, the image analyzer 110, may include circuitry in a controller, a microprocessor, or an application specific integrated circuit (ASIC), or may be implemented with discrete logic or components, or a combination of other types of analog or digital circuitry, combined on a single integrated circuit or distributed among multiple integrated circuits. A product, such as a computer program product, may include a storage medium and machine readable instructions stored on the medium, which when executed in an endpoint, computer system, or other device, cause the device to perform operations according to any of the description above.

The processing capability of the systems, devices, and circuitry described herein, including the image analyzer 110, may be distributed among multiple system components, such as among multiple processors and memories, optionally including multiple distributed processing systems. Parameters, databases, and other data structures may be separately stored and managed, may be incorporated into a single memory or database, may be logically and physically organized in many different ways, and may implemented in many ways, including data structures such as linked lists, hash tables, or implicit storage mechanisms. Programs may be parts (e.g., subroutines) of a single program, separate programs, distributed across several memories and processors, or implemented in many different ways, such as in a library, such as a shared library (e.g., a dynamic link library (DLL)). The DLL, for example, may store code that performs any of the system processing described above.

While various examples have been described above, many more implementations are possible.

The invention claimed is:

1. A method comprising:

accessing an image of a light projection that extends continuously across a print substrate and a background surface beside the print substrate;

identifying a break point in the image where a gap defined by a discontinuity in the light projection occurs; and determining a thickness of the print substrate, using the break point in the image, the thickness being determined as a length of the gap at the break point in the image.

2. The method of claim 1, comprising determining an edge location of the print substrate as an offset of the break point from a device position of an image capture device used to capture the image.

3. The method of claim 1, further comprising, prior to identifying the break point in the image:

processing the image to educe optical skew caused by an image capture: angle.

4. The method of claim 1, further comprising, when different portions of the print substrate have different thicknesses:

identifying multiple break points in the image; and determining the different thicknesses of the print substrate from the multiple break points.

5. The method of claim 1, wherein the image of the light projection represents light reflected from a surface plane of the print substrate and light reflected from the background surface.

6. A device comprising:

a light projector to cause a light projection that extends continuously across a print substrate and a background surface beside the print substrate;

an image capture device to capture an image of the light projection across the print substrate and the background surface; and an image analyzer to:

identify a break point in the image where a gap defined by a discontinuity in the light projection occurs; and determine a thickness of the print substrate, using the break point in the image, the thickness being determined as a length of the gap at the break point in the image; and provide the thickness of the print substrate to a printer controller to adjust a print setting.

7. The device of claim 6, wherein the image analyzer is to determine an edge location of the print substrate as an offset of the break point from a device position of the image capture device.

8. The device of claim 6, wherein the image analyzer is further to, prior to identifying the break point in the image:

process the image to reduce optical skew caused by an image capture angle between the image capture device and the print substrate.

9. The device of claim 6, wherein the light projector is to cause the light projection by projecting a collimated light across the print substrate and the background surface.

10. The device of claim 6, wherein the image capture device is to capture the image of the light projection at a substrate input area of a printing device.

11. The device of claim 6, wherein the image capture device is pointed towards a surface plane of the print substrate and the background surface.

12. The device of claim 6, wherein the image capture device is positioned above the background surface and wherein the print substrate is positionable on top of the background surface.

13. The device of claim 6, wherein the light projector is to emit a line of light projection across the print substrate and the background surface.

14. A non-transitory machine-readable medium comprising executable instructions that, when executed by a processor, cause the processor to:

access an image of a print substrate on a background surface with a light projection that extends continuously across the print substrate and the background surface;

process the image to increase a contrast between the light projection in the image and the print substrate and background surface; and after processing the image:

identify a break point in the image where a gap defined by a discontinuity in the light projection occurs; and analyze the image to determine a thickness of the print substrate according to the break point, the thickness being determined as a length of the gap at the break point in the image.

15. The non-transitory machine-readable medium of claim 14, wherein the executable instructions cause the processor to determine an edge location of the print substrate as an offset of the break point from a device position of an image capture device used to capture the image.

16. The non-transitory machine-readable medium of claim 14, wherein the executable instructions cause the processor to process the image further by reducing optical skew in the image caused by an image capture angle between the print substrate and an image capture device used to capture the image.

* * * * *